US012714199B2

(12) United States Patent
Reddy

(10) Patent No.: US 12,714,199 B2
(45) Date of Patent: Aug. 25, 2026

(54) CUSHIONING HEEL BAND FOR FOOTWEAR

(71) Applicant: Prasad Reddy, Argyle, TX (US)

(72) Inventor: Prasad Reddy, Argyle, TX (US)

( * ) Notice: Subject to any disclaimer, the term of this patent is extended or adjusted under 35 U.S.C. 154(b) by 0 days.

(21) Appl. No.: 19/000,850

(22) Filed: Dec. 24, 2024

(65) Prior Publication Data

US 2026/0174188 A1 Jun. 25, 2026

(51) Int. Cl.
*A43B 21/32* (2006.01)
*A43B 23/02* (2006.01)

(52) U.S. Cl.
CPC ..... *A43B 21/32* (2013.01); *A43B 23/02* (2013.01)

(58) Field of Classification Search
CPC ..... A43B 21/32; A43B 23/02; A43B 21/26; A43B 21/265; A43B 21/28; A43B 21/285
See application file for complete search history.

(56) References Cited

U.S. PATENT DOCUMENTS 4,970,807 A 11/1990 Anderie et al.
5,005,300 A 4/1991 Diaz
5,363,570 A * 11/1994 Allen ..... A43B 13/20 36/35 B
5,402,588 A 4/1995 Graham
5,572,805 A * 11/1996 Giese ..... A43B 13/188 36/31
5,758,435 A 6/1998 Miyata
5,782,014 A 7/1998 Peterson
5,918,383 A 7/1999 Chee
6,061,928 A 5/2000 Nichols
8,316,560 B2 11/2012 Caron
11,330,863 B2 5/2022 Reddy et al.
2004/0093766 A1 5/2004 Hahn
2008/0060221 A1 3/2008 Hottinger
2010/0122471 A1 5/2010 Edington
2022/0167710 A1* 6/2022 Reddy ..... A43B 13/186

* cited by examiner

*Primary Examiner* — Khoa D Huynh
*Assistant Examiner* — Erick I Lopez
(74) *Attorney, Agent, or Firm* — Brian K. Yost; Kiala E. Ellingson; Decker Jones, PC

(57) ABSTRACT

A cushioning heel band for footwear and an article of footwear are provided. The article of footwear has an upper configured to engage with a wearer's foot when worn on the wearer's foot and a sole having a heel portion and a forefoot portion. The heel band is U-shaped and is positioned on the heel portion. The heel band has opposing first and second surfaces, and a perimeter wall that define a channel adapted to retain cushioning material. The cushioning material may have resilient balls. The heel band contacts a midsole heel portion upper surface which is lower than a midsection upper surface. The footwear may have a forefoot cavity and/or a heel cavity. Each is adapted to retain a cavity cushion. The heel cavity is defined by the heel band, midsole heel portion, and a front wall positioned at a juncture of the midsole heel portion and the midsection.

24 Claims, 4 Drawing Sheets

CUSHIONING HEEL BAND FOR FOOTWEAR

FIELD OF THE INVENTION

The present invention relates to footwear such as shoes, boots, and so on, and in particular to a cushioning heel band for footwear.

BACKGROUND OF THE INVENTION

Footwear comes in a variety of types and sizes, including sandals, shoes and boots. Footwear includes soles that protect and cushion the bottoms of the feet.

When walking, the heel of the foot strikes the ground first, followed by the forefoot. As the foot pushes off, the foot bends so that the heel rises and the forefoot is the last part to remain in contact with the ground. The heel takes the brunt of the force of the foot contacting the ground. Yet, the forefoot also experiences forces when the foot is landing on the ground and pushing off therefrom.

Much walking is done on hard surfaces, such as concrete, tile, etc. For example, walking on sidewalks and across streets involves concrete or asphalt surfaces. A footwear sole protects the foot from contact and abrasion with such hard surfaces.

In the prior art, Gaspard, EU Patent No. 0383685, discloses a shoe sole with balls in the outsole. The balls are loosely provided in the outsole and are designed to move about. Anderie, U.S. Pat. No. 4,970,807, provides an outsole of flexible plastic material for sports shoes with a recess beneath the heel support surface for accommodating a plurality of cushioning balls comprising a resilient material. Caron, U.S. Pat. No. 8,316,560, discloses footwear comprising a window between the midsole and the outsole arranged such that a bladder is visible through the window. Hottinger, U.S. Pat. Pub No. 2008/0060221, teaches a shoe with a loose fill material in a heel compartment on which the heel of the wearer rests. Nichols, U.S. Pat. No. 6,061,928, provides a shoe with cushioning elements adjacent to side surfaces of a pocket of the sole assembly and about the periphery of the heel region. Hahn, U.S. Pat. Pub No. 2004/0093766, provides a cushion containing a massage element and/or active medical agents in the interior of the shoe, above the sole, The cushion has a flexible base panel on the bottom, corresponding to the shape of the sole, and an elastic protective nonwoven fabric on the top. Applicant is also one of the inventors in Reddy et al, U.S. Pat. No. 11,330,863, an invention related to a cushioning for shoe sole. Graham, U.S. Pat. No. 5,402,588, discloses a shoe having a heel frame that provides cushioning. Chee, U.S. Pat. No. 5,918,383, teaches a sports shoe insert which includes elastically deformable elements which extend vertically within a heel portion of the shoe. Eddington, Pat. Pub. No. US 2010/0122471, provides a shoe having raised balls in the heel. Lateral shell and lower force-distribution plate portion may be transparent or translucent to permit viewing of the balls by a user through the side portions of a heel or through portions of an outsole, such as outsole. Peterson, U.S. Pat. No. 5,782,014, teaches an athletic shoe with a "spring cushioned midsole". The midsole can comprise a mock window is positioned at the rear of the shoe or at other positions (e.g. in the sole and/or along the side of the shoe). The mock window can display a mock version of the cushioning projections disposed in the midsole of the shoe. Diaz, U.S. Pat. No. 5,005,300, provides horizontal tube elements extending the width of the midsole which are encapsulated in the elastomeric material. Miyata, U.S. Pat. No. 5,758,435, discloses a footwear having regularly arranged weight chambers formed in a resilient outsole.

It is desired to provide a cushioning heel band for footwear that provides improved protection, comfort, and style.

SUMMARY OF THE INVENTION

A cushioning heel band for footwear is provided. The heel band is positioned above a midsole heel portion and contacts, directly or indirectly, an upper surface of the midsole heel portion. The heel band provides improved protection, comfort, and style.

An article of footwear comprises an upper configured to engage with a wearer's foot when the article of footwear is worn on the wearer's foot. In preferred embodiments, a sole has a heel portion, a midfoot portion, and a forefoot portion. The upper is connected to the sole, the footwear may comprise one or more cavities adapted to receive cushion portions. For example, the cavities can be located in the heel portion or the forefoot portion such that the sole comprises a forefoot cavity and/or a heel cavity. The respective cushions are positioned within the respective cavities such that a forefoot cushion is positioned within the forefoot cavity and a heel cushion is positioned within the heel cavity. The cushions may comprise conventional and commercially available cushioning material such as foam, foam-like material such as Ethylene Vinyl Acetate (EVA), rubber, thermoplastic rubber (TPR), polyurethane (PU), leather or other manmade or natural cushioning materials known in the art. In preferred embodiments, the forefoot and heel cushions comprise resilient balls located in a resilient matrix material.

Although the footwear of preferred embodiments comprises one or more cavities adapted to receive cushion portions, the footwear need not comprise cavities adapted to receive cushion portions. Rather, in certain embodiments, the sole is a unitary structure with cushioning material integrated within the sole itself.

In certain embodiments, the sole comprises an outsole and a midsole. The outsole has a lower surface that is configured to engage with a surface on which the wearer is striding. The outsole has an upper surface that contacts a lower surface of the midsole. The midsole has an upper surface and a lower surface. The lower surface contacts the upper surface of the outsole. The midsole, either by itself or in conjunction with other elements of the footwear, may have the cavity or cavities that receive the respective cushions.

In preferred embodiments, the midsole comprises a midsection. The midsole heel portion of preferred embodiments is recessed with respect to the midsection such that an upper surface of the heel portion is lower than an upper surface of the midsole midsection. The midsole heel portion and midsection are connected to one another via a front wall. The midsole heel portion extends rearward from the midsection to a rear portion of the midsole. In plan view, the midsole heel portion comprises a conventional shape such that a rear end comprises a curved configuration and such that the midsole heel portion generally conforms to the shape of a heel perimeter of the wearer (in plan view).

The heel band of the preferred embodiment is U-shaped and is adapted to be positioned along a perimeter of the midsole heel portion. The midsole heel band comprises a first surface, a second surface opposite the first surface, first and second end walls, and a perimeter wall. The perimeter wall extends from an outside edge of the first end wall to an outside edge of the second end wall and joins the first and second surfaces to one another at distal edges of the first and second surfaces. Together, the heel band first surface, second surface, first and second end walls, and perimeter wall define a channel. The channel is adapted to contain a cushioning material. In preferred embodiment, the cushioning material is one or more resilient balls. In preferred embodiments, the band is at least partially transparent such that the balls can be seen through the band.

When positioned on the heel portion as described, the heel band, heel portion, and front wall define the heel cavity. As discussed, the heel cavity is adapted to receive the heel cushion.

In accordance with another aspect, the heel cavity is separated from a forefoot cavity by the midsection of the midsole.

In accordance with another aspect, the midsole comprises a lower portion located between the cushion and the outsole, the cavity being open to an upper surface of the midsole.

In accordance with another aspect, the balls in the channel form a single layer of balls.

In accordance with another aspect, each of the balls in the channel is interconnected with adjacent respective balls by spacing pins. The spacing pins creating gaps between adjacent respective balls.

In accordance with another aspect, matrix material substantially surrounds each of the balls in the channel.

In accordance with another aspect, there is an upper cover over the midsole and heel cushion and a portion of the heel band.

In accordance with another aspect, the heel band is at least translucent to provide a visual indication of the balls in the channel. The heel band is exposed to an exterior of the footwear.

An article of footwear comprises an upper configured to engage with a wearer's foot when the article of footwear is worn on the wearer's foot. An outsole has an upper surface and a lower surface that is configured to engage with a surface on which the wearer is striding. A midsole has a midsole lower surface that contacts the upper surface of the outsole. A heel band comprises a channel comprising resilient balls. The midsole and heel band together or in combination with other elements of the footwear, define a heel cavity. A cushion is located in the heel cavity, the cushion comprising resilient balls located in a resilient matrix material. The heel band being at least translucent to provide a visual indication of the balls in the channel.

DESCRIPTION OF THE PREFERRED EMBODIMENT

Figure 1:
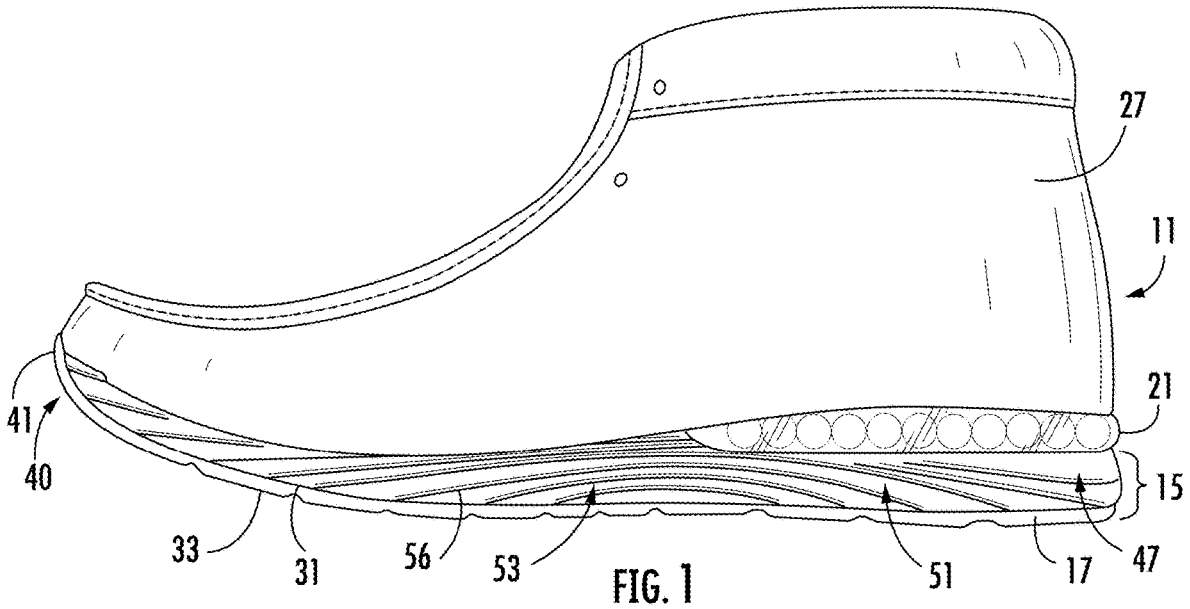
FIG. 1 is a side elevation view of the footwear of the present invention, in accordance with a preferred embodiment.

The present invention provides a cushioning heel band for footwear 11 that is both comfortable and provides support to the foot. The heel band 21 has a channel 22 which contains resilient balls 23. The balls 23 can be loose or encompassed within a resilient matrix material. In some embodiments the balls 23 contained within the channel 22 are joined to adjacent balls 23 by spacing pins 24. The balls 23 provide cushioning for the foot and lateral support for the heel. The balls 23 may be hidden from view. In other embodiments, the heel band 21 is at least translucent to provide a visual indication of the balls 23 in the channel 22.

The footwear 11 includes shoes, boots and so on. Examples of footwear 11 include casual shoes, recreational shoes, athletic shoes, outdoor shoes and dress shoes. Further examples of footwear 11 include cowboy boots, western boots, riding boots, outdoor boots, hiking boots and work boots. Additional examples of footwear 11 include specialty footwear 11 such as military boots.

Referring to FIGS. 1-10, the footwear sole 13 is part of a piece of footwear 11. The footwear sole 13 includes an outsole 17, a midsole 19, a heel band 21, and balls 23. The outsole 17 is the part of the sole 13 that contacts the ground. The midsole 19 is located above the outsole 17. The heel band 21 is positioned above the midsole and the balls 23 are located in a channel 22 within the heel band 21. The footwear 11 also includes an upper 27. The upper 27 typically has an insole, footbed, fabric, and/or some other material that covers the midsole 19. The upper 27 is secured to the upper part 52 of the midsole 19.

Except as otherwise indicated, as used herein, the terms "upper", "lower", "top" and "bottom", "downward" and "upward", and similar terms are used to describe spatial relationships between components of the footwear 11 and/or between a component of the footwear 11 and the ground. Such terms are relative to the footwear 11 positioned in an upright orientation on a ground surface. "Ground" includes interior floors and exterior surfaces such as streets, sidewalks, soil, etc. Except as otherwise indicated, "Inward" or similar terms is used to describe approximate spatial relationships between components of the footwear 11 and a longitudinal centerline 93 of the footwear 11. Except as otherwise indicated, as used herein, the terms "contact", "contacting", "positioned on" and similar terms are used to describe close relative proximity of respective components. For example, for purposes of this disclosure, a first component glued to second component is still "contacting" the second component even though a thin layer of glue may theoretically separate the two components.

Figure 3:
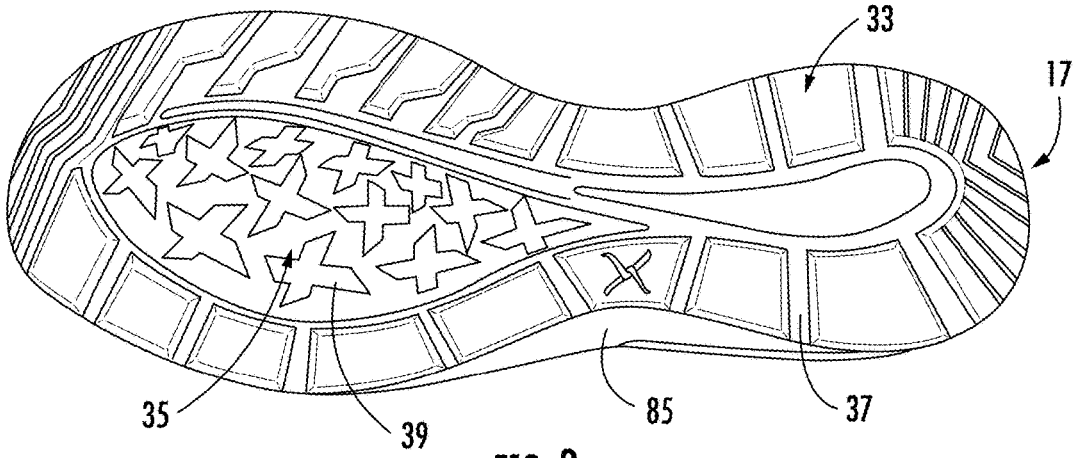
FIG. 3 is a bottom and partial left side isometric view of the footwear outsole.
Figure 4:
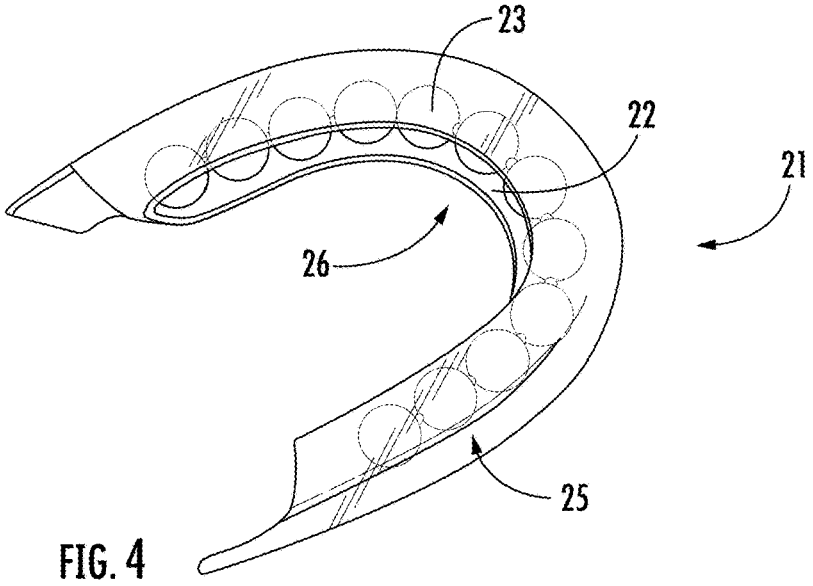
FIG. 4 is a top and left side isometric view of the heel band with balls in position within the heel band.

The outsole 17 extends the length of the footwear 11 and has an upper surface 31 and a lower surface 33, as shown in FIG. 1. The outsole lower surface 33 contacts the ground when the footwear 11 is worn in normal use. The outsole lower surface 33 is configured to engage with the ground or other surface upon which the wearer of the footwear 11 is striding or walking. The outsole lower surface 33 is typically provided with a tread pattern 35, an example of which is shown in FIG. 3. The tread pattern 35 may include a distinct tread structure, such as including a non-smooth surface, and in some embodiments including tread projections 39, tread troughs 37, and the like. The outsole lower surface 33 may also be smooth in some or all areas.

The outsole upper surface 31 contacts a midsole lower surface 50. The outsole upper surface 31 is typically smooth, although need not be so. In one embodiment, the outsole upper surface 31 can be pockmarked with craters or shallow depressions, which depressions correspond to circular shaped tread projections 39 on the lower surface 33. The outsole 17 may have upwardly extending side projections 41, which projections couple to the side portions 53 of the midsole 19. Such side projections 41 are located at a toe portion of the outsole 40, at the heel 15, and at locations between the toe portion 40 and heel 15. In the embodiment shown in FIGS. 1, 2, 7, & 8, the side projection 41 extends upward to a position proximate to a toe portion of the midsole 49 and the heel 15 is of the flat type. Alternatively, the heel 15 can be a projecting type heel.

Figure 7:
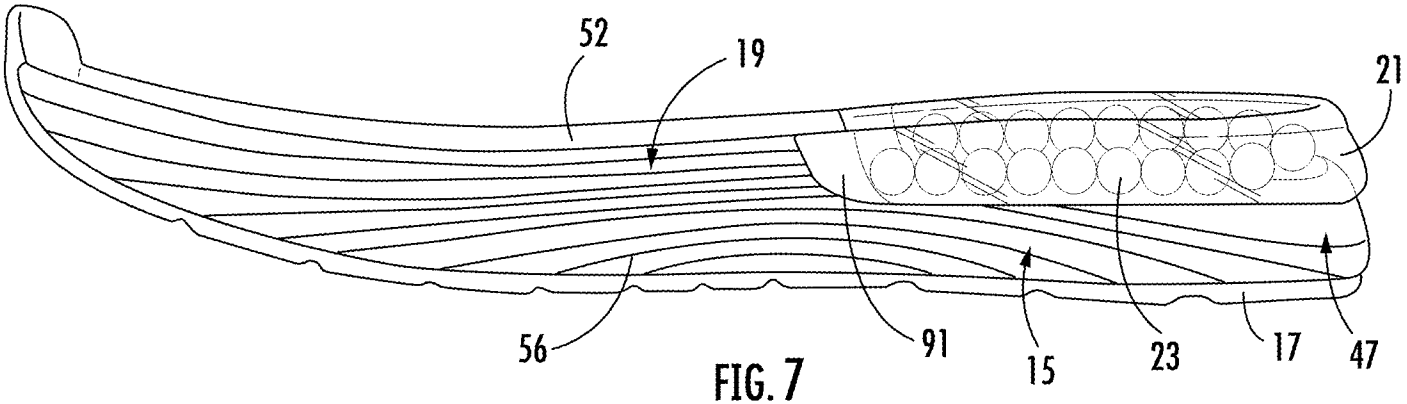
FIG. 7 is a side elevation view of the footwear midsole, outsole, and heel band.
Figure 8:
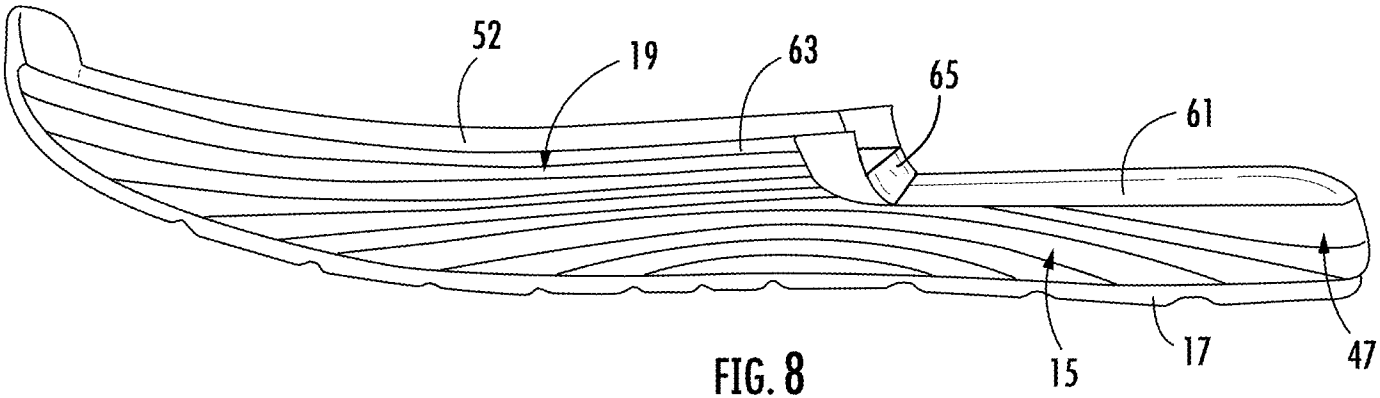
FIG. 8 is a side elevation view of the footwear midsole, outsole, with the heel band removed.
Figure 9:
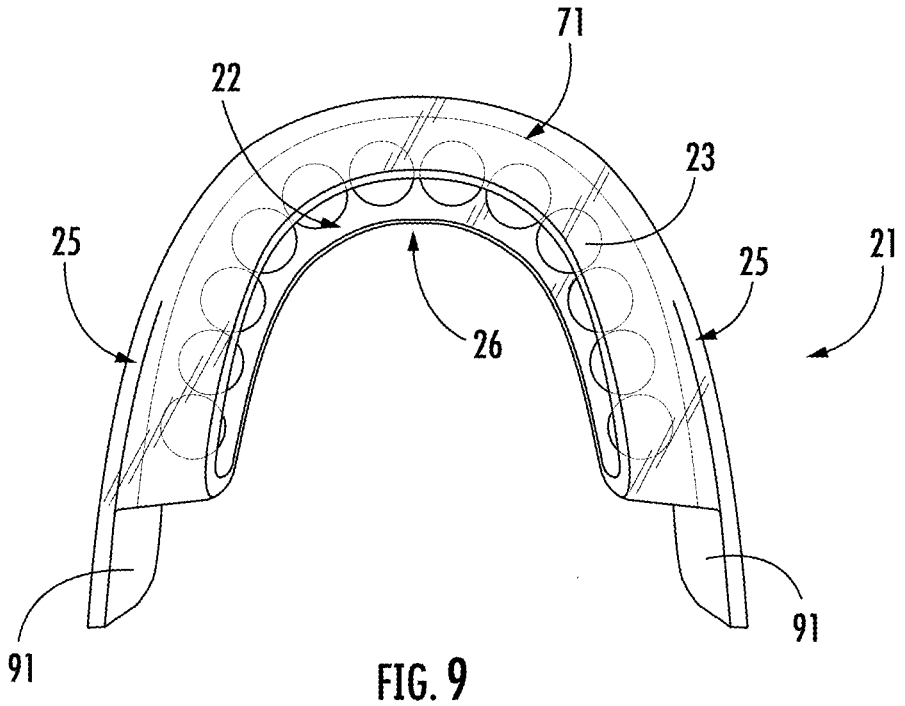
FIG. 9 is a top and front isometric view of the heel band of FIG. 4.
Figure 10:
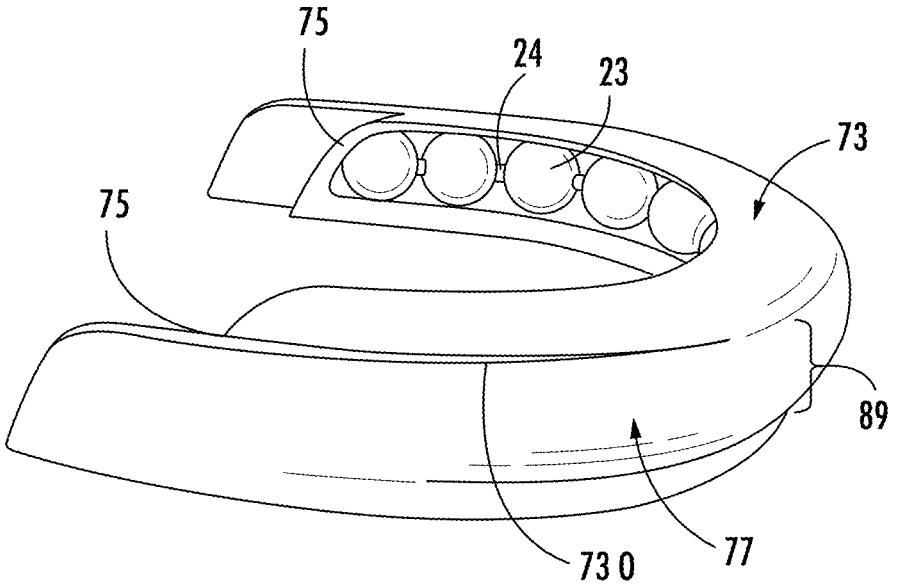
FIG. 10 is a bottom and right side isometric view of the heel band of FIGS. 4 and 9.

The midsole 19 is sized and shaped to fit on top of the outsole 17 and the side projections 41. Along with the midsole toe portion 49 and the midsole side portions 53, the midsole 19 has a midsole heel portion 51. Outside surfaces of the midsole side portions 53 may either be smooth or have a non-smooth surface; for example, the midsole side portions 53 may comprise grooves 56 as shown in FIGS. 1,7-8. The midsole 19 has an upper surface 54 and a lower surface 50. The midsole 19 has a forefoot cavity 55 and, by itself or in combination with other elements of the footwear 11, a midsole heel cavity 57. The forefoot cavity 55 and the midsole heel cavity 57 are separated from one another by a midsection 59. Each of the cavities 55, 57 is open on the top. In certain embodiments, one or both the cavities 55, 57 are closed at the bottom.

The forefoot cavity 55 (see FIG. 2) is generally oblong, extending from the toe portion 49 of the midsole 19 to the midsection 59 and from one lateral portion 58 of the midsole upper surface 54 to an opposite lateral portion 58.

The heel cavity 57 (see FIG. 2) extends from the heel band 21 to the midsection 59 and from one side portion 25 of the heel band 21 to the opposite side portion 25 of the heel band 21. The midsole 19 has a front wall 65 at a juncture of the midsole heel portion 51 and the midsection 59. The depth of the heel cavity 57 is greater than the depth of the forefoot cavity 55. The heel cavity 57 may optionally have a projecting lip (not shown) that extends from the front of the cavity 57 towards the heel 15 for a distance.

The midsole 19 may have a midsection cavity (not shown). The midsection cavity may be open at the bottom and have a closed top. Alternatively, the midsection cavity can be closed at the bottom and open at the top.

In embodiments wherein the forefoot and heel cavities 55, 57 are open at the bottom, when the midsole 19 is coupled to the outsole 17, the bottoms of the forefoot and heel cavities 55, 57 are closed by the outsole 17.

Figure 2:
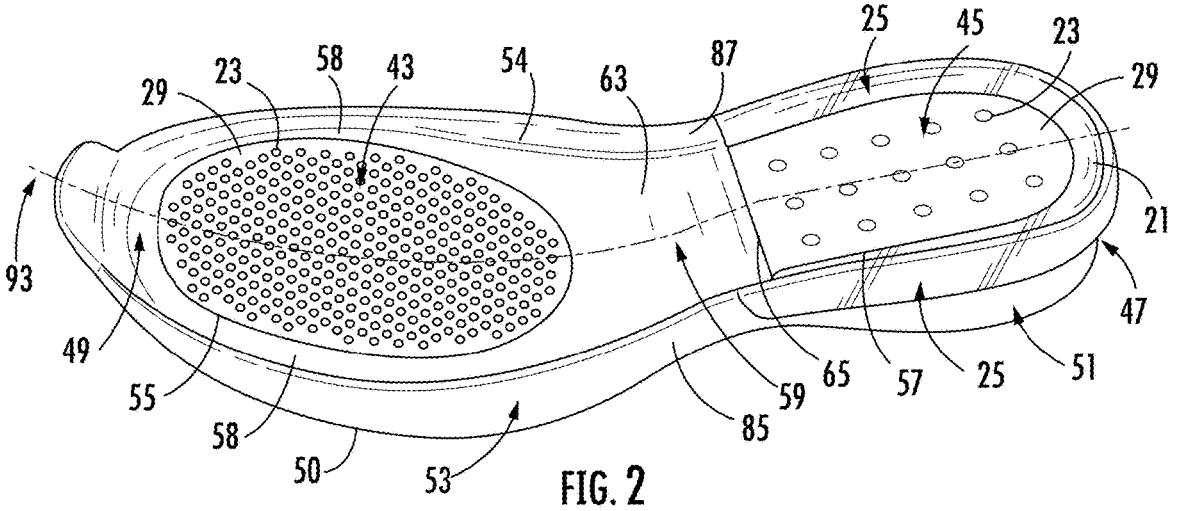
FIG. 2 is an isometric view of the footwear of FIG. 1, with the upper removed.

Referring to FIG. 2, the respective forefoot cavity 55 and the heel cavity 57 contain respective cavity cushions 43, 45. The cavity cushions 43, 45 are positioned within the respective cavities 55, 57 such that the forefoot cavity cushion 43 is positioned within the forefoot cavity 55 and the heel cavity cushion 45 is positioned within the heel cavity 57. The cavity cushions 43, 45 may comprise conventional and commercially available cushioning material such as foam, foam-like material such as Ethylene Vinyl Acetate (EVA), rubber, thermoplastic rubber (TPR), polyurethane (PU), leather, or other manmade or natural cushioning materials known in the art. In preferred embodiments, the forefoot and heel cavity cushions 43, 45 comprise resilient balls 23 or spheres located in a resilient matrix material 29. Although the footwear 11 of preferred embodiments comprises one or more cavities 55, 57 adapted to receive cushion portions, the footwear 11 need not comprise cavities adapted to receive cavity cushions 43, 45. Rather, in certain embodiments, the sole 13 is a unitary structure with cushioning material integrated within the sole 13 itself.

In preferred embodiments, the midsole heel portion 51 is recessed with respect to the midsection 59 such that an upper surface 61 of the midsole heel portion 51 is lower than an upper surface 63 of the midsole midsection. The midsole heel portion 51 and midsection 59 are connected to one another via the front wall 65. The midsole heel portion 51 extends rearward from the midsection 59 to a rear end 47 of the midsole 19. In plan view, the midsole heel portion 51 comprises a conventional shape such that the rear end 47 comprises a curved configuration and such that the midsole heel portion 51 generally conforms to the shape of a heel perimeter of the wearer (in plan view).

In preferred embodiments, the heel band 21 is positioned above the midsole heel portion 51 and contacts, directly or indirectly, the upper surface 61 of the midsole heel portion 51. The heel band 21 provides improved protection, comfort, and style. The heel band 21 of the preferred embodiment is U-shaped and is adapted to be positioned along a perimeter of the midsole heel portion 51.

Referring to FIGS. 4-6 and 9-10, the heel band 21 comprises a first surface 71, a second surface 73 opposite the first surface 71, first and second end walls 75, 75, and a perimeter wall 77. The perimeter wall 77 spans between and joins the first and second surfaces 71, 73 to one another. In preferred embodiments, the perimeter wall 77 extends from an outside edge 75 O of the first end wall 75 to an outside edge 75 O of the second end wall 75 and joins the first and second surfaces 71, 73 to one another at respective outside edges 71 O, 73 O of the first and second surfaces 71, 73. Together, the heel band first surface 71, second surface 73, first and second end walls 75, 75, and perimeter wall 77 define a channel 22. In some embodiments, the heel band 21 does not comprise the end walls 75, 75. In such embodiments the channel 22 is defined by the heel band first surface 71, second surface 73, first and second end walls 75, 75, and perimeter wall 77 and the channel 22 extends between respective ends of the heel band first surface 71, second surface 73.

Figure 5:
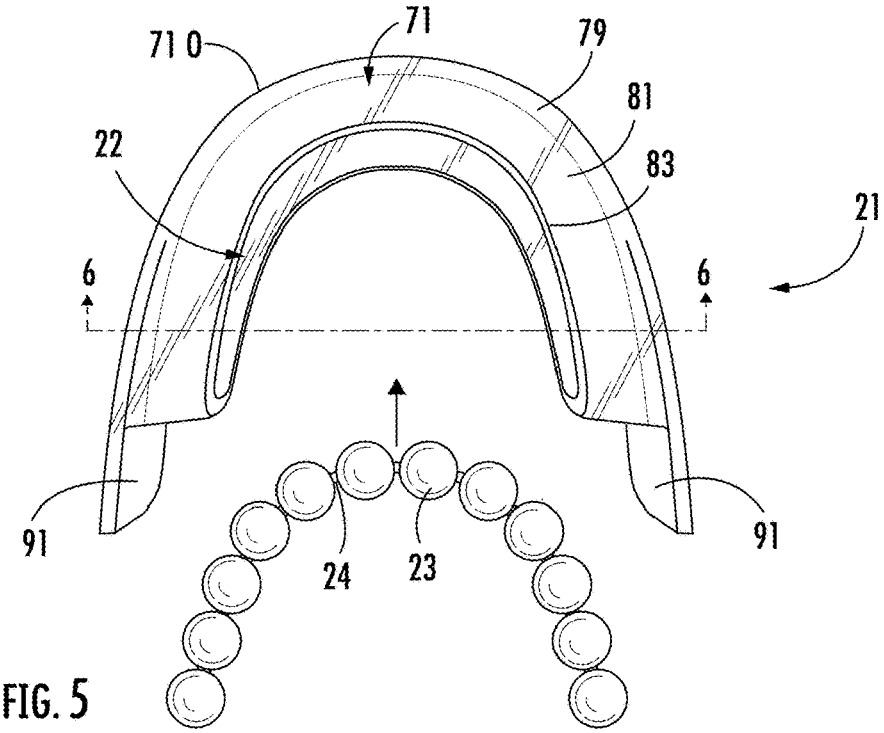
FIG. 5 is a front and top isometric view of the heel band with the balls shown outside the channel.
Figure 6:
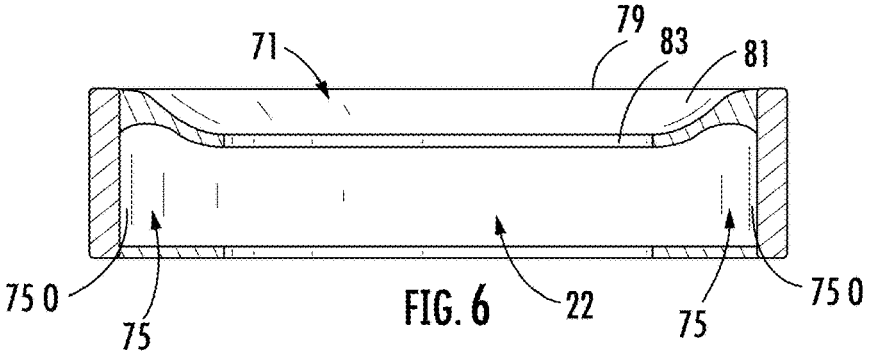
FIG. 6 is a sectional view cut along the line 6-6 of FIG. 5.

In preferred embodiments, the first surface 71 is an upper surface of the heel band 21, and the second surface 73 is a lower surface of the heel band 21. In such embodiments, as best shown in FIGS. 5 and 6, the heel band 21 first surface 71 comprises an upper ridge 79, an upper ridge inside radius 81, and a lower ridge 83. In a preferred embodiment, the upper ridge 79 is flat. In other embodiments, the upper ridge 79 is angular or pointed (not shown). The upper ridge 79 adjoins the upper ridge inside radius 81. The radius 81 is concave such that it curves downward from the upper ridge 79 and inward to the lower ridge 83. With this configuration, the radius 81 provides a comfortable resting place for a portion of the wearer's heel. The upper ridge inside radius 81 of the heel band 21 first surface 71 is approximately the same radius as that which is defined by midsection sides 85 which comprise a midsection side radius 87 which is similarly concave. The midsection side radius 87 also contributes to the wearer's comfort.

The perimeter wall 77 of preferred embodiments, comprises a convex radius 89 such that the perimeter wall curves outward from the upper ridge 79 and the heel band second surface 73. With this configuration, the heel band 21 when positioned on the midsole heel portion 51 is slightly wider than the midsole heel portion 51. In such an embodiment, the heel band may be exposed to an exterior of the footwear.

In certain embodiments, the heel band 21 comprises forward tangs 91. These tangs 91 facilitate attachment of the heel band 21 to the midsole 19. The tangs 91 are essentially forward extensions of the perimeter wall 77. When the heel band 21 is positioned on the midsole heel portion 51 the tangs 91 overlap or underlap portions of the respective midsection sides 85. This configuration permits other points of attachment between the heel band 21 and the midsole 19. The tangs 91 can be secured to the respective midsection sides 85 with adhesives or other footwear attachment means known in the art.

As shown in the figures, the channel 22 of the heel band 21 of preferred embodiments is enclosed on five sides by the first surface 71, the second surface 73, the first and second end walls 75, 75, and the perimeter wall 77. A channel opening 26 permits the balls 23 to easily be positioned within the channel 22. In preferred embodiments, the channel opening 26 extends from the first and second end walls 75, 75 and from the first surface 71 to the second surface 73.

Although the heel band 21 of preferred embodiments comprises a channel opening 26, the heel band 21 need not comprise a channel opening 26. Rather, the channel 22 can be completely enclosed by, for example, an interior perimeter wall.

The channel 22 is adapted to contain one or more resilient balls 23. The balls 23 provide cushioning for the foot and lateral support for the heel. In preferred embodiments, the heel band 21 is at least partially transparent such that the balls 23 can be seen through the heel band 21. However, the heel band 21 need not be transparent. The balls 23 may be hidden from view. In other embodiments, the heel band 21 is at least translucent to provide a visual indication of the balls 23 in the channel 22.

The balls 23 can be loose or encompassed within a resilient matrix material 29. In some embodiments the balls 23 contained within the channel 22 are joined to adjacent balls 23 by spacing pins 24. Although the heel band 21 of preferred embodiments comprises balls 23 positioned within the channel 22, other materials known in the art can be positioned within the channel 22. For example, cushioning material comprising foam, foam-like material such as EVA, rubber, TPR, PU, leather or other manmade or natural materials known in the art can be positioned within the channel 22. In certain embodiments, the channel 22 is not filled with any material such that the channel 22 remains hollow. In still other embodiments, the heel band 21 does not comprise a channel 22 and is thus, solid core. In such embodiments, the heel band 21 may be formed from a unitary piece of resilient material such as TPR, PU, polyethylene or EVA. Or, in such embodiments, the heel band 21 may be formed from a combination of suitable materials. In some embodiments, the heel band comprises a ball 23 and matrix 29 arrangement.

In some embodiments, the heel band 21 and heel cavity cushion 45 are formed from a unitary piece of material such that the heel band 21 and heel cavity cushion 45 are also a unitary piece of material. In other embodiments, the heel band 21 and heel cavity cushion 45 are fused to one another prior to being positioned on the midsole 19. For example, the heel band 21 and heel cavity cushion 45 may be attached to one another by conventional means such as glue, adhesive, chemical bonding, welding, physical bonding (threading), and the like.

When the heel band 21 is positioned on the midsole heel portion 51 as described herein, the heel band 21, midsole heel portion 51, and front wall 65 define the heel cavity 57. As discussed herein, the heel cavity 57 is adapted to receive the heel cavity cushion 45.

The balls 23 contained within the heel band channel 22 are solid and made of a resilient material such as TPR, PU, polyethylene or EVA. The Shore C hardness is between 40-68. The balls 23 in the heel band channel 22 are typically larger than the balls 23, if any, contained within the forefoot cavity cushion 43. The size of the balls 23, in some embodiments, depends on footwear size (with larger footwear sizes having larger balls 23 than smaller footwear sizes). For example, the balls 23 in the forefoot cavity 55 can be 4-12 mm in diameter, while the balls 23 in the heel cavity 57 and heel band 21 can be 8-18 mm in diameter.

In embodiments in which the forefoot cavity cushion 43 comprises balls 23, the forefoot cavity 55 has a single layer of balls 23. In embodiments in which the heel cavity cushion 45 comprises balls 23, the heel cavity 57 has either a double layer, or a single layer, of balls 23. The balls 23 may be in contact with one another or separated by the matrix 29 and/or spacing pins 24. In such embodiments, the balls 23 in each cavity 55, 57 may be loose and not attached to one another. The tops of the balls 23 in each respective cavity 55, 57 are flush with the respective surfaces that surround the respective cavities 55, 57. Thus, in the preferred embodiment, the balls 23 do not protrude out of the top of each cavity 55, 57.

Once the forefoot and heel cushions 43, 45 have been placed into the respective cavities 55, 57, the cavities 55, 57 and a footbed, fabric, or other covering is inserted within the footwear 11, the forefoot cavity 55 and heel cavity 57 are closed off from viewing.

The outsole 17 is preferably made of synthetic or natural rubber, while the midsole 19 is preferably made of EVA or PU. The midsole is softer than the outsole. Typically, the outsole 17 has a Shore A hardness of 62-72. Safety toe footwear 11 have harder outsoles 17 than soft toe footwear 11. Typically, the midsole 19 has a Shore C hardness of 55-60.

To assemble the footwear sole 13, the midsole 19 is coupled to the outsole 17 by adhesive or other conventional footwear coupling means known in the art. In embodiments with open bottom forefoot and heel cavities 55, 57, with the midsole 19 coupled to the outsole 17, the bottoms of the forefoot and heel cavities 55, 57 are closed. The heel band 21 is attached to the midsole heel portion 51. If the heel band comprises forward tangs 91, the tangs can be secured to the respective midsection sides 85 as described previously herein in order to facilitate attachment of the heel band 21 to the midsole heel portion 51. Balls 23 are positioned within the channel 22 of the heel band 21. The forefoot and heel cavity cushions 43, 45 are placed into each cavity 55, 57. When positioned on the midsole 19, the top surfaces of the cavity cushions 43, 45 are preferably flush with the upper surface 54 of the midsole 19 that surrounds each cavity cushion 43, 45. The sole 13 is now assembled.

Once the cushions 43, 45 are positioned within the cavities 55, 57, the upper 27 is attached to the sole 13. The upper 27 may comprise fabric, a footbed, insole, or other structure which serves to cover the cavities 55, 57. With attachment of the upper 27 to the sole 13, the assembly of the footwear 11 is complete.

In use, when foot pressure is not applied to the heel band 21, the balls 23 within the heel band 21 are generally spherical in shape. As foot pressure is applied the heel band 21, the balls 23 within the heel band 21 compress in the area of the balls to which the foot pressure is applied. The balls 23 within the heel band 21 under the highest foot pressure compress more. As the foot pressure is released, such as during walking when the foot is raised to take the next step, the balls 23 within the heel band 21 resume their spherical shape. The wearer thus experiences softened steps. If walking over a hard ground surface such as concrete, the wearer's feet are protected from the hardness of the ground.

Even though the balls 23 in the forefoot and heel cavities 55, 57 are hidden from view, the balls 23 in the heel band 21 are visible through the perimeter wall 77 and first surface of the heel band 21. Thus, a customer, when shopping for footwear, can view the balls 23 and visually affirm that the footwear heel band 21 contains balls 23.

The foregoing disclosure and showings made in the drawings are merely illustrative of the principles of this invention and are not to be interpreted in a limiting sense.

I claim:

1. An article of footwear, comprising:

a) an upper configured to engage with a wearer's foot when the article of footwear is worn on the wearer's foot;

b) a sole having a heel portion and a forefoot portion, the upper connected to the sole;

c) a heel band positioned on the heel portion, the heel band comprising a U-shaped configuration and a first surface, a second surface, a first end wall, a second end wall, and a perimeter wall, the second surface being opposite the first surface, the perimeter wall spanning between and joining the first and second surfaces to one another;

d) wherein the first surface, the second surface, the first end wall, the second end wall, and the perimeter wall define a channel, the channel having a lateral channel opening that extends from the first end wall to the second end wall to permit a cushioning material to be inserted into the channel.

2. The article of footwear of claim 1, further comprising the cushioning material, wherein the channel retains the cushioning material.

3. The article of footwear of claim 1, wherein:

a. the sole comprises an outsole and a midsole;

b. the outsole having an outsole upper surface and an outsole lower surface that is configured to engage with a surface on which a wearer is striding;

c. the midsole having a midsole lower surface that contacts the outsole upper surface;

d. the midsole having a midsole upper surface;

e. the heel band contacts the midsole upper surface.

4. The article of footwear of claim 3, wherein:

the midsole comprises a midsole heel portion, the midsole heel portion having a midsole heel portion upper surface;

the heel band contacts the midsole heel portion upper surface.

5. The article of footwear of claim 4, wherein the midsole comprises a midsection, the midsection having a midsection upper surface;

wherein the midsole heel portion upper surface is lower than the midsection upper surface.

6. The article of footwear of claim 1, wherein:

a. the sole has at least one cavity located in the heel portion or the forefoot portion;

b. a cushion is located in the cavity.

7. The article of footwear of claim 6, wherein:

the cushion comprises resilient balls.

8. The article of footwear of claim 7, wherein the at least one cavity comprises a sole heel cavity, the sole heel cavity defined by the heel band, a midsole heel portion, and a front wall, the front wall being positioned at a juncture of the midsole heel portion and a midsection of the midsole.

9. The article of footwear of claim 8, wherein the at least one cavity comprises a forefoot cavity.

10. The article of footwear of claim 9, wherein the heel cavity is separated from the forefoot cavity by the midsection of the midsole.

11. The article of footwear of claim 7, wherein:

the resilient balls are located in a resilient matrix material.

12. The article of footwear in claim 1, wherein the heel band is at least partially transparent or translucent.

13. The article of footwear of claim 1, wherein:

the heel band further comprises a first forward-facing projection and a second forward-facing projection extending from the perimeter wall;

the midsection further comprises a lateral midsection side portion and a medial midsection side portion;

wherein the first forward-facing projection overlaps the lateral midsection side portion, and the second forward-facing projection overlaps the medial midsection side portion, to permit secure attachment of the heel band to the midsole.

14. An article of footwear, comprising:

an upper configured to engage with a wearer's foot when the article of footwear is worn on the wearer's foot;

a sole having a heel portion and a forefoot portion, the upper connected to the sole;

a heel band positioned on the heel portion, the heel band comprising a U-shaped configuration, a first surface, a second surface, a first end wall, a second end wall, and a perimeter wall, the second surface being opposite the first surface, the perimeter wall spanning between and joining the first and second surfaces to one another;

the first surface, the second surface, the first end wall, the second end wall, and the perimeter wall define a channel, the channel having a lateral channel opening that extends from the first end wall to the second end wall to permit a cushioning material to be inserted into the channel, the channel retaining the cushioning material.

15. The article of footwear of claim 14, wherein:

the sole comprises an outsole and a midsole;

the outsole having an outsole upper surface and an outsole lower surface that is configured to engage with a surface on which a wearer is striding;

the midsole having a midsole lower surface that contacts the outsole upper surface;

the midsole having a midsole upper surface;

the heel band contacts the midsole upper surface.

16. The article of footwear of claim 15, wherein:

the midsole comprises a midsole heel portion, the midsole heel portion having a midsole heel portion upper surface;

the heel band contacts the midsole heel portion upper surface;

the midsole comprises a midsection, the midsection having a midsection upper surface;

the midsole heel portion upper surface is lower than the midsection upper surface;

the article of footwear further comprises a sole heel cavity, the sole heel cavity defined by the heel band, the midsole heel portion, and a front wall, the front wall being positioned at a juncture of the midsole heel portion and the midsection.

17. The article of footwear of claim 14 wherein the cushioning material in the channel comprises resilient balls.

18. The article of footwear of claim 17 wherein the resilient balls are interconnected with adjacent respective resilient balls by spacing pins, the spacing pins creating gaps between adjacent respective resilient balls.

19. The article of footwear of claim 14, wherein the heel band is at least partially transparent or translucent.

20. A heel band for footwear, the heel band comprising:

a. a U-shaped configuration and a first surface, a second surface, a first end wall, a second end wall, and a perimeter wall, the second surface being opposite the first surface, the perimeter wall spanning between and joining the first and second surfaces to one another;

b. the first surface, the second surface, the first end wall, the second end wall, and the perimeter wall defining a channel, the channel having a lateral channel opening that extends from the first end wall to the second end wall to permit a cushioning material to be inserted into the channel.

21. The heel band of claim 20, wherein the channel is adapted to retain the cushioning material.

22. The heel band of claim 20, wherein the heel band is at least partially transparent or translucent.

23. The heel band of claim 20, wherein the channel retains the cushioning material.

24. The heel band of claim 23, wherein the cushioning material comprises resilient balls.

* * * * *